US010792827B2

(12) United States Patent
Treu et al.

(10) Patent No.: US 10,792,827 B2
(45) Date of Patent: Oct. 6, 2020

(54) SAFETY RAZOR HANDLE

(71) Applicant: BEIERSDORF AG, Hamburg (DE)

(72) Inventors: Jens Treu, Norderstedt (DE); Michael Lessmann, Winsen-Luhe (DE); Yvonne Neumann, Hamburg (DE); Kesen Zeng, Hamburg (DE)

(73) Assignee: BEIERSDORF AG, Hamburg (DE)

( * ) Notice: Subject to any disclaimer, the term of this patent is extended or adjusted under 35 U.S.C. 154(b) by 0 days.

(21) Appl. No.: 15/414,235

(22) Filed: Jan. 24, 2017

(65) Prior Publication Data

US 2017/0217035 A1 Aug. 3, 2017

(30) Foreign Application Priority Data

Jan. 29, 2016 (DE) ..... 10 2016 101 672

(51) Int. Cl.
*B26B 21/52* (2006.01)
*B26B 21/22* (2006.01)

(52) U.S. Cl.
CPC ..... *B26B 21/522* (2013.01); *B26B 21/225* (2013.01); *B26B 21/521* (2013.01); *B26B 21/528* (2013.01)

(58) Field of Classification Search
CPC ... B26B 21/522; B26B 21/225; B26B 21/521; B26B 21/528; B26B 21/24; B26B 21/4012; B26B 21/4062; B26B 21/4068; B26B 21/227; B26B 21/222; B26B 21/4037
USPC ..... 30/526, 532, 527, 530, 531, 47, 50, 32, 30/90, 85, 34.05, 34.1–34.2; D28/44, D28/45–48
See application file for complete search history.

(56) References Cited

U.S. PATENT DOCUMENTS

| | | | | | |
|---|---|---|---|---|---|
| 4,833,779 | A | | 5/1989 | Iten | |
| 5,784,790 | A | | 7/1998 | Carson, III et al. | |
| D445,958 | S | | 7/2001 | Dansreau et al. | |
| D563,047 | S | * | 2/2008 | Ramm | D28/48 |
| D598,606 | S | * | 8/2009 | Watson | D28/48 |
| D604,012 | S | * | 11/2009 | Jung | D28/46 |
| D615,705 | S | * | 5/2010 | Ramm | D28/47 |
| D635,718 | S | * | 4/2011 | White, Jr. | D28/48 |
| D651,345 | S | * | 12/2011 | Micinilio | D28/48 |
| D659,287 | S | * | 5/2012 | Psimadas | D28/48 |
| D698,997 | S | * | 2/2014 | Micinilio | D28/46 |

(Continued)

FOREIGN PATENT DOCUMENTS

| | | | |
|---|---|---|---|
| GB | 2207074 | A | 1/1989 |
| WO | 2006081841 | A1 | 8/2006 |

(Continued)

*Primary Examiner* — Ghassem Alie
(74) *Attorney, Agent, or Firm* — Abel Schillinger, LLP

(57) ABSTRACT

Described is a razor handle in the form of an elongated body. The handle has a razor head end with a structure for connecting to a razor head and a free end opposite the razor head end. The handle further has a lower surface on the same side as the cutting edges of the blades when the razor head is connected to the razor handle and an upper surface opposite the lower surface. On the upper surface there is a first gripping area for providing a first gripping position for a finger or thumb of the user and a second gripping area for providing a second gripping position for the finger or thumb. The first and second gripping areas having textured surfaces and are separated from one another by a smooth area of the upper surface.

16 Claims, 12 Drawing Sheets

(56) References Cited

U.S. PATENT DOCUMENTS

| | | | | |
|---|---|---|---|---|
| D818,196 | S * | 5/2018 | Szymanski | D28/46 |
| 2004/0177518 | A1 | 9/2004 | Leventhal | |
| 2008/0127500 | A1 | 6/2008 | Gratsias et al. | |
| 2008/0189964 | A1* | 8/2008 | Bozikis | B26B 21/521 30/526 |
| 2009/0113730 | A1* | 5/2009 | Psimadas | B26B 21/522 30/526 |
| 2011/0030229 | A1* | 2/2011 | Psimadas | B26B 21/222 30/536 |
| 2011/0088269 | A1* | 4/2011 | Walker, Jr. | B26B 21/225 30/527 |
| 2012/0167401 | A1 | 7/2012 | Quigley et al. | |
| 2014/0230256 | A1 | 8/2014 | Christie et al. | |
| 2015/0290822 | A1* | 10/2015 | Haba | B26B 21/225 30/526 |
| 2017/0001323 | A1 | 1/2017 | Furuta | |

FOREIGN PATENT DOCUMENTS

| | | | |
|---|---|---|---|
| WO | 2006086314 | A1 | 8/2006 |
| WO | 2007000185 | A1 | 1/2007 |
| WO | 2009124597 | A1 | 10/2009 |
| WO | 2015080113 | A1 | 6/2015 |

* cited by examiner

SAFETY RAZOR HANDLE

CROSS-REFERENCE TO RELATED APPLICATIONS

The present application claims priority under 35 U.S.C. § 119 of German Patent Application No. 10201622101672.1, filed Jan. 29, 2016, the entire disclosure of which is expressly incorporated by reference herein.

BACKGROUND OF THE INVENTION

1. Field of the Invention

The present invention relates to safety razor handles and, in particular, to safety razor handles provided with gripping areas.

2. Discussion of Background Information

Safety razors typically include a handle, a razor head having a plurality of blades, and a connecting structure to connect the handle to the razor head. Although known handle designs are provided with various gripping features, it would be desirable to provide an improved handle design that enables the user to easily locate different possible gripping positions.

SUMMARY OF THE INVENTION

In one of its embodiments, the present invention provides a razor handle in the form of an elongated body, comprising: a razor head end with a connecting structure, to connect the razor handle to a razor head having a plurality of blades with respective cutting edges which lie in a shaving plane and which exert a cutting action when moved across a user's skin in a shaving direction; a free end opposite the razor head end; a lower surface on the same side as the cutting edges of the blades when the razor head is connected to the razor handle; an upper surface opposite the lower surface; a first gripping area on the upper surface, to provide a first gripping position for a finger or thumb of the user; and a second gripping area on the upper surface, to provide a second gripping position for the finger or thumb of the user. The first and second gripping areas have textured surfaces and are separated from one another by a smooth area of the upper surface.

The alternately textured and smooth upper surface of the razor handle indicates, through tactile feedback to the user, different possible finger (thumb) placement positions, and thereby enables the user to easily locate different possible gripping positions.

The first and second gripping areas can be disposed one in front of the other in the longitudinal direction of the razor handle, with the first gripping area closer to the razor head end than the second gripping area. (The first gripping area can therefore be thought of as a proximal gripping area, the second gripping area as a distal gripping area, and the smooth area between the first and second gripping areas as an intermediate area.) This allows the user to easily switch between the first and second gripping positions, by simply bending or extending their finger or thumb. For instance, the user can utilise the first gripping position (the proximal gripping area) to make short, precise strokes when shaving around the ankles for example, and then switch to the second gripping position (the distal gripping area) to make long, smooth strokes to shave the calves and thighs for example.

It has been observed that, when users grip razor handles closer to the razor head their fingertips can approach a perpendicular angle relative to the handle, and that, when users grip razor handles further away from the razor head their fingertips can tend to flatten out. As the fingertip flattens out the, fingertip contact area typically becomes larger. Accordingly the second gripping area (which can be further away from the razor head) can be made larger (cover a larger surface area) than the first gripping area to allow better grip in the second gripping position. The first gripping area can be about twice the length of the second gripping area along the central longitudinal axis of the razor handle. For example, the first gripping area can be between about 0.5 cm and 1 cm in length along the central longitudinal axis of the razor handle, e.g., about 0.7 cm. The second gripping area can be between about 1.0 cm and 2.0 cm in length along the central longitudinal axis of the razor handle, e.g. about 1.4 cm. Other dimensions are possible, though the aforementioned lengths are advantageous for good fingertip contact. The arcuate protrusions can, for example, be between about 0.025 cm and 0.05 cm in height.

The first and second gripping areas may be closer to the razor head end than the free end. This allows the user to comfortably grasp the handle, for example with the free end of the handle in the palm of their hand with the ring and little fingers on the lower surface of the handle, the thumb and middle finger on either of sides of the handle, and the index finger gripping the first or second gripping areas.

The first gripping area may abut or adjoin a pivoting mechanism at the razor head end that allows the razor head to pivot. Any suitable pivoting mechanism can be employed that allows the razor head to follow the contours of the area being shaved. For example, the pivoting mechanism can comprise an elastomeric element (elastomeric diaphragm) held in place (surrounded) by a circular retaining structure of the razor head end, and holding (surrounding) an upper portion of the connecting structure.

The gripping areas may have any suitable shape or form that provides good grip for preventing the finger or thumb from sliding or slipping during use of the handle, such as grooves, ribs, bumps or other protrusions, combinations and mixtures of the foregoing or the like. However, advantageously at least one of the first and second gripping areas may be provided by a plurality of arcuate protrusions which are in the form of at least partial circles concentric with each other. For example, at least one of the plurality of arcuate protrusions, such as the innermost arcuate protrusion (closest to the concentric centre), can form a complete circle. In some cases, the plurality of protrusions arcuate form partial and complete circles. Such rippled gripping surfaces can provide good fingertip grip and better indicate to the user where to grip the handle. As used herein, the term "arcuate" generally refers to a rounded or curved shape. The term "circles" is intended to include ovals, ellipses, egg shapes, and other generally round shapes.

The first and second gripping areas may each be provided by a plurality of arcuate protrusions, and the concentric centers of the first and second gripping areas can be aligned longitudinally along the central longitudinal axis of the razor handle. At least one of each the plurality of arcuate protrusions of the first and second gripping areas, for example each of the innermost arcuate protrusion (closest to the concentric center), can form complete circles. In some cases, at least the second innermost arcuate protrusion (next closest to the concentric center) of the second gripping area can also form a complete circle. The concentric centre of the plurality of arcuate protrusions of the first gripping area may be spaced apart from the concentric centre of the plurality of arcuate protrusions of the second gripping area by between about 1.5 cm and 2.5 cm, e.g., by about 2 cm, along the central longitudinal axis of the razor handle. Other dimensions are possible, though the aforementioned distances advantageously provide good gripping positions that can be accessed by the same finger.

The smooth area which separates the first gripping area from the second gripping area can extend continuously between the first and second gripping areas, to allow a smooth transition when the user changes grip. For example, the smooth area may be between about 0.5 cm and 1.5 cm, e.g., about 1 cm, in length along the central longitudinal axis of the razor handle. Other dimensions are possible, though the aforementioned distances advantageously allow the user to easily switch between the first and second gripping positions simply by extending or bending their index finger for example.

The handle may comprise an elastomeric material provided on a rigid plastic material for structural stability. For example, the upper surface may be of an elastomeric material that is integral with the first and second gripping areas. A majority of the upper surface can be of an elastomeric material. Accordingly, the upper surface with the first and second gripping areas can be easily manufactured for example by injection molding.

Although the elongated body can have any number of shapes and sizes, the elongated body can have a generally S-shaped configuration extending from the razor head end to the free end. This ergonomic shape allows the handle to be grasped naturally in the palm of the hand, with the finger or thumb resting on the first or second gripping areas.

In another embodiment the present invention provides a razor, comprising: the aforementioned razor handle; and the razor head. The razor head may be detachable from the razor handle. Alternatively, the razor head may be integral with the razor handle.

The razor head may include a connecting structure to engage with the connecting structure of the razor head end of the handle, the connecting structure of the razor head including a release button to release the razor head from the razor handle, the release button aligned with the first and second gripping areas.

The release button may be mounted on an arm which is resiliently bendable towards a fixed structure of the razor head when the release button is pressed, the release button having a downwardly extending projection to abut an upwardly extending projection of the fixed structure to limit the movement of the arm when the release button is pressed.

One embodiment provides a razor assembly, comprising: the aforementioned razor, wherein the razor head includes a guard in front of the plurality of blades and a cap behind the plurality of blades, and the razor assembly further comprises a protective cover to at least partially cover each of the guard, the cap and the plurality of blades.

In another embodiment the present invention provides a method of manufacturing a razor handle in the form of an elongated body, comprising: providing the elongated body with a razor head end with a connecting structure, to connect the razor handle to a razor head having a plurality of blades with respective cutting edges which lie in a shaving plane and exert a cutting action when moved across a user's skin in a shaving direction; providing the elongated body with a free end opposite the razor head end; providing the elongated body with a lower surface on the same side as the cutting edges of the blades when the razor head is connected to the razor handle; providing the elongated body with an upper surface opposite the lower surface; providing the elongated body with a first gripping area on the upper surface, to provide a first gripping position for a finger or thumb of the user; and providing the elongated body with a second gripping area on the upper surface, to provide a second gripping position for the finger or thumb of the user, wherein the first and second gripping areas have textured surfaces and are separated from one another by a smooth area of the upper surface The above indicated aspects, embodiments and features may be combined with each other to achieve the advantageous effects as described above. Further embodiments, features, and advantages of the invention, as well as the structure and operation of the various embodiments of the invention are described in detail below with reference to the accompanying drawings.

BRIEF DESCRIPTION OF THE DRAWINGS

Some embodiments will now be described with reference to the following figures, which are not necessarily to scale, and in which like numerals describe like components in different views.

DETAILED DESCRIPTION OF EMBODIMENTS OF THE PRESENT INVENTION

Figure 1:
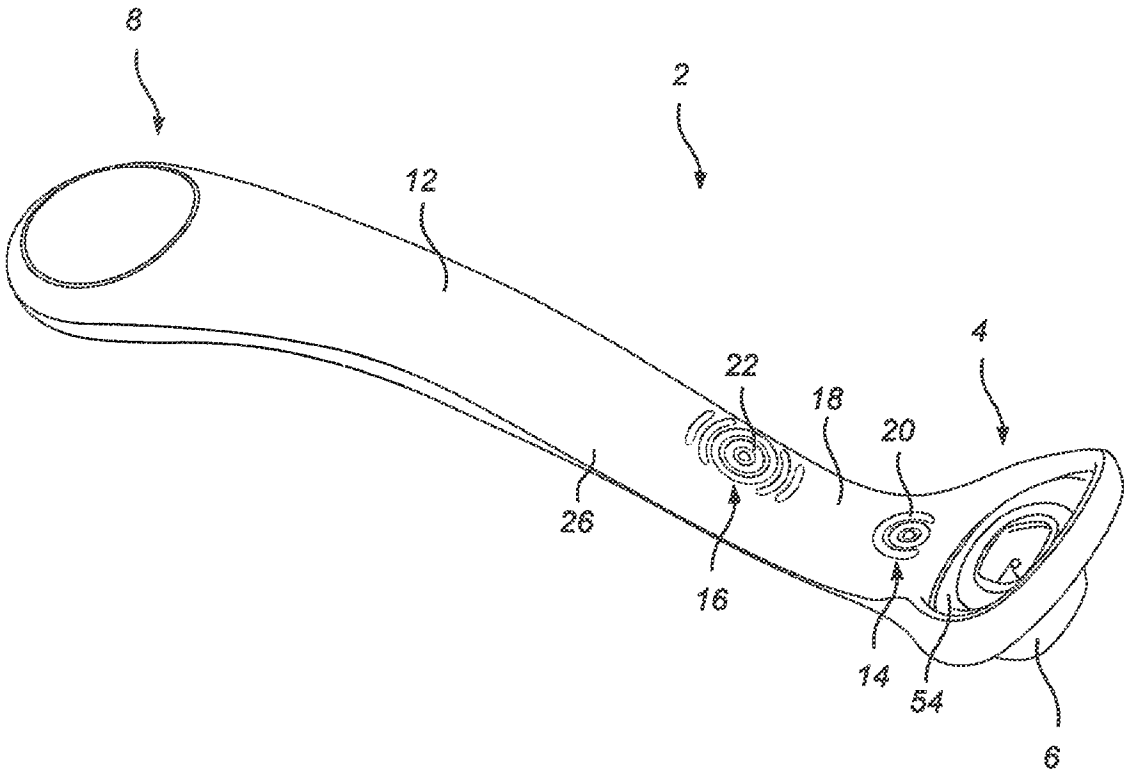
FIG. 1 is a top perspective view of a safety razor handle.
Figure 2:
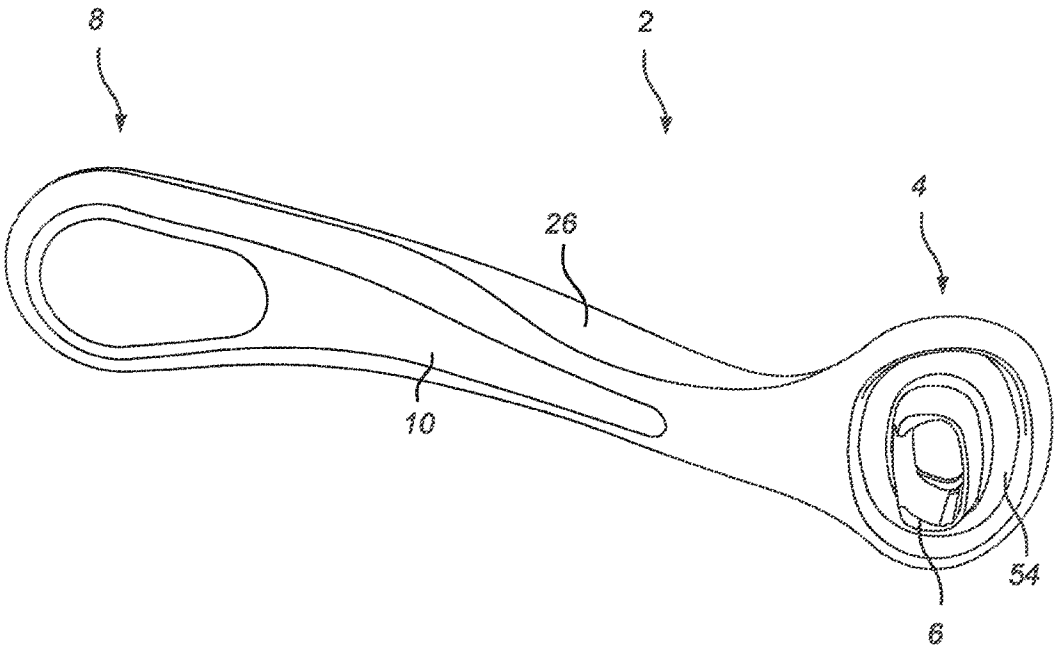
FIG. 2 is a bottom perspective view of the safety razor handle of FIG. 1.
Figure 3:
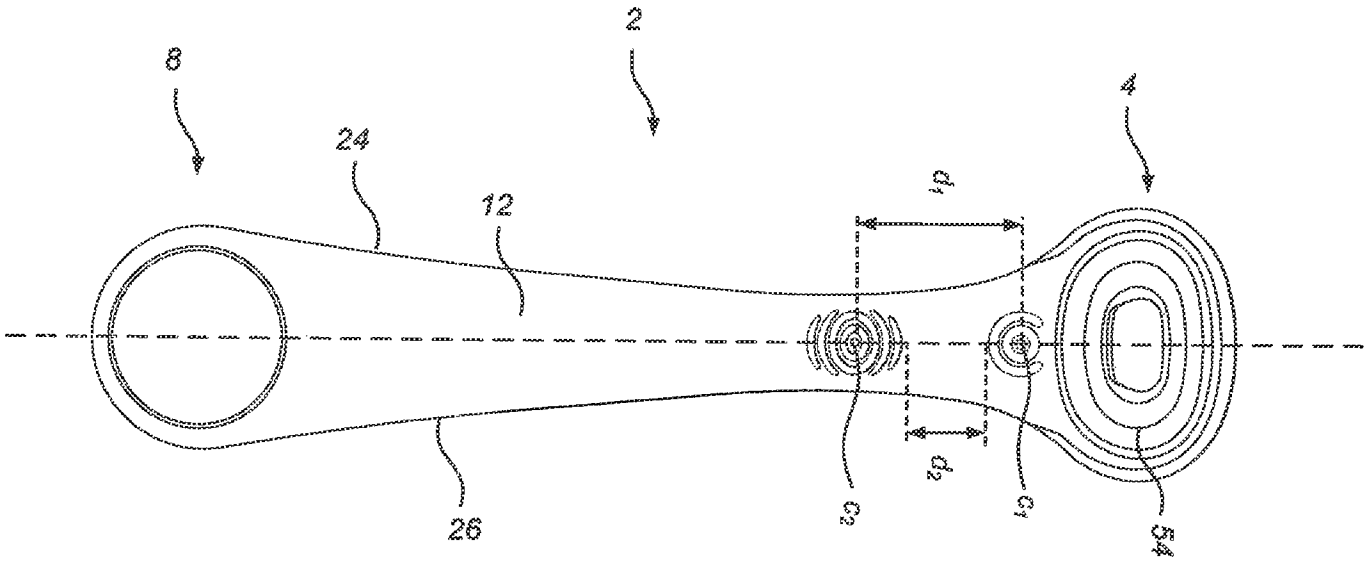
FIG. 3 is a top view of the safety razor handle of FIG. 1.
Figure 4:
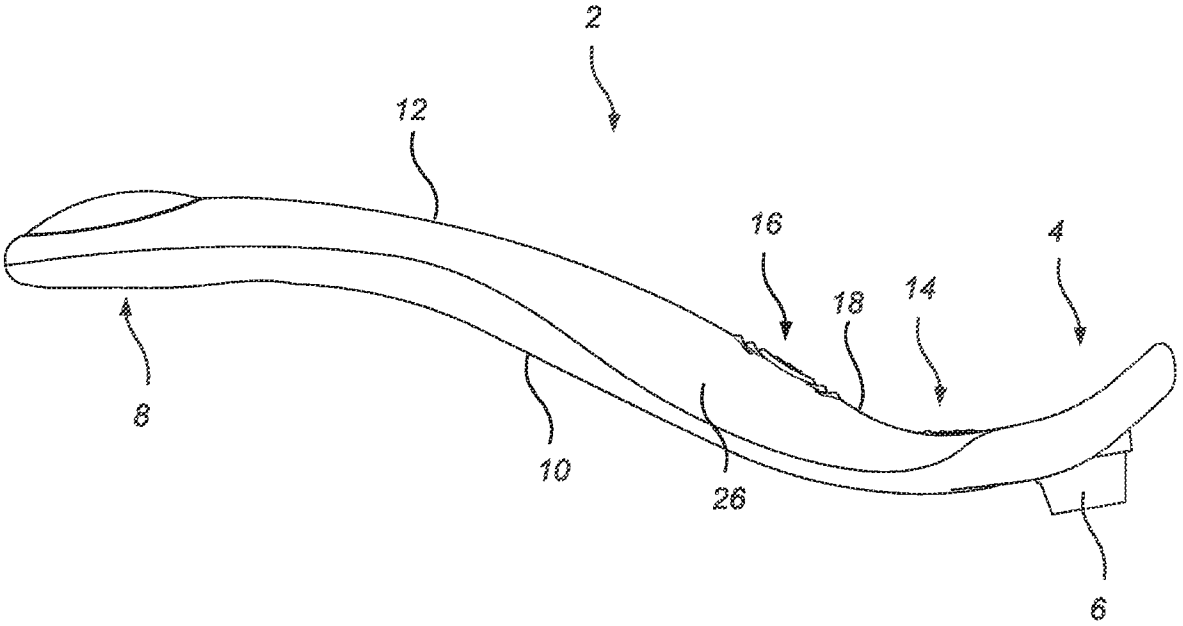
FIG. 4 is a side view of the safety razor handle of FIG. 1.
Figure 5:
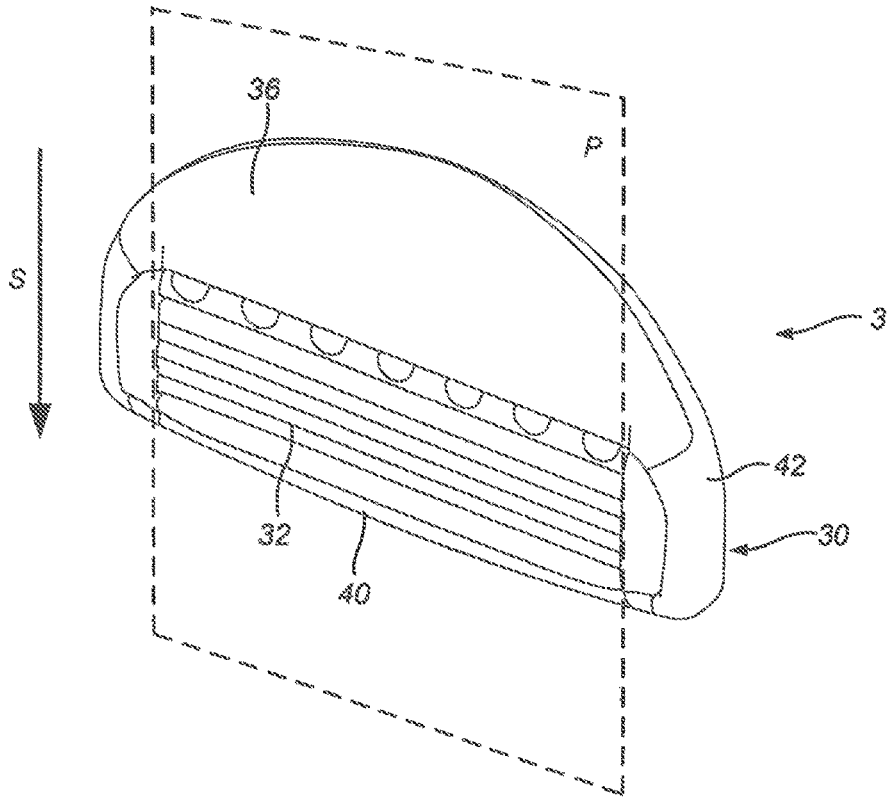
FIG. 5 is a bottom perspective view of a razor head.
Figure 6:
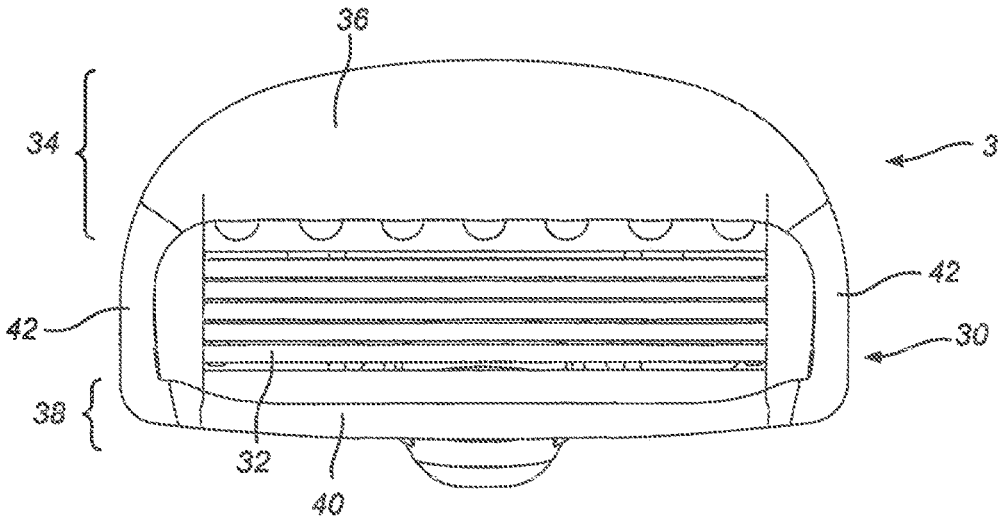
FIG. 6 is a bottom view of the razor head of FIG. 5.
Figure 7:
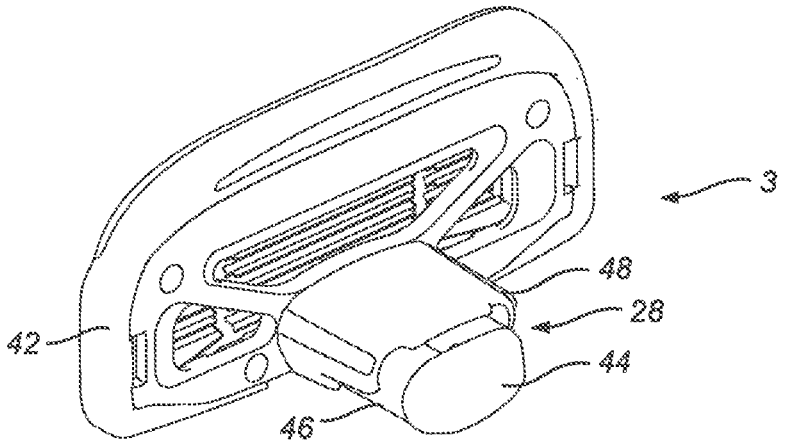
FIG. 7 is a top perspective view of the razor head of FIG. 5.
Figure 8:
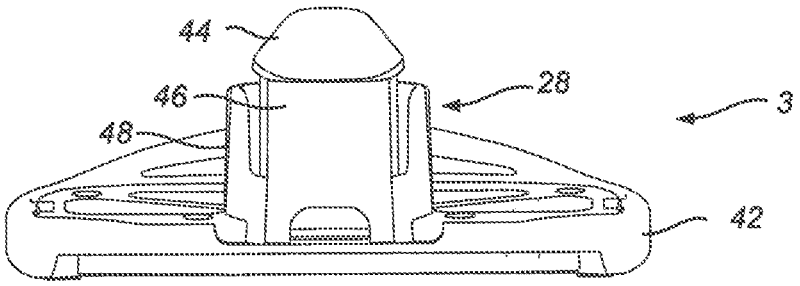
FIG. 8 is a front view of the razor head of FIG. 5.
Figure 9:
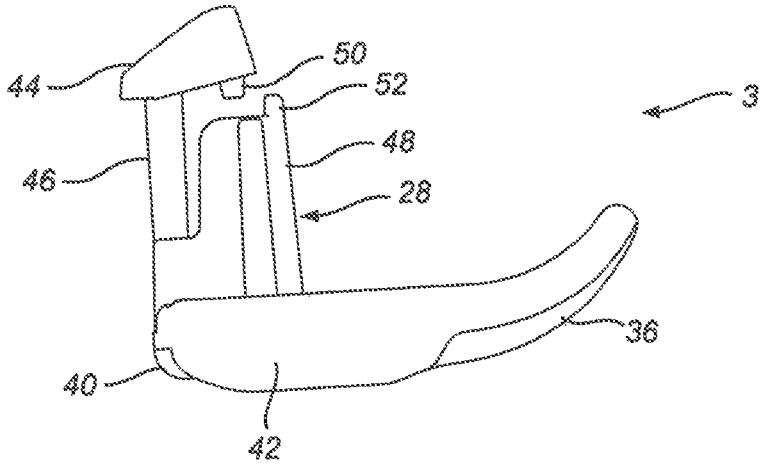
FIG. 9 is a side view of the razor head of FIG. 5.
Figure 10:
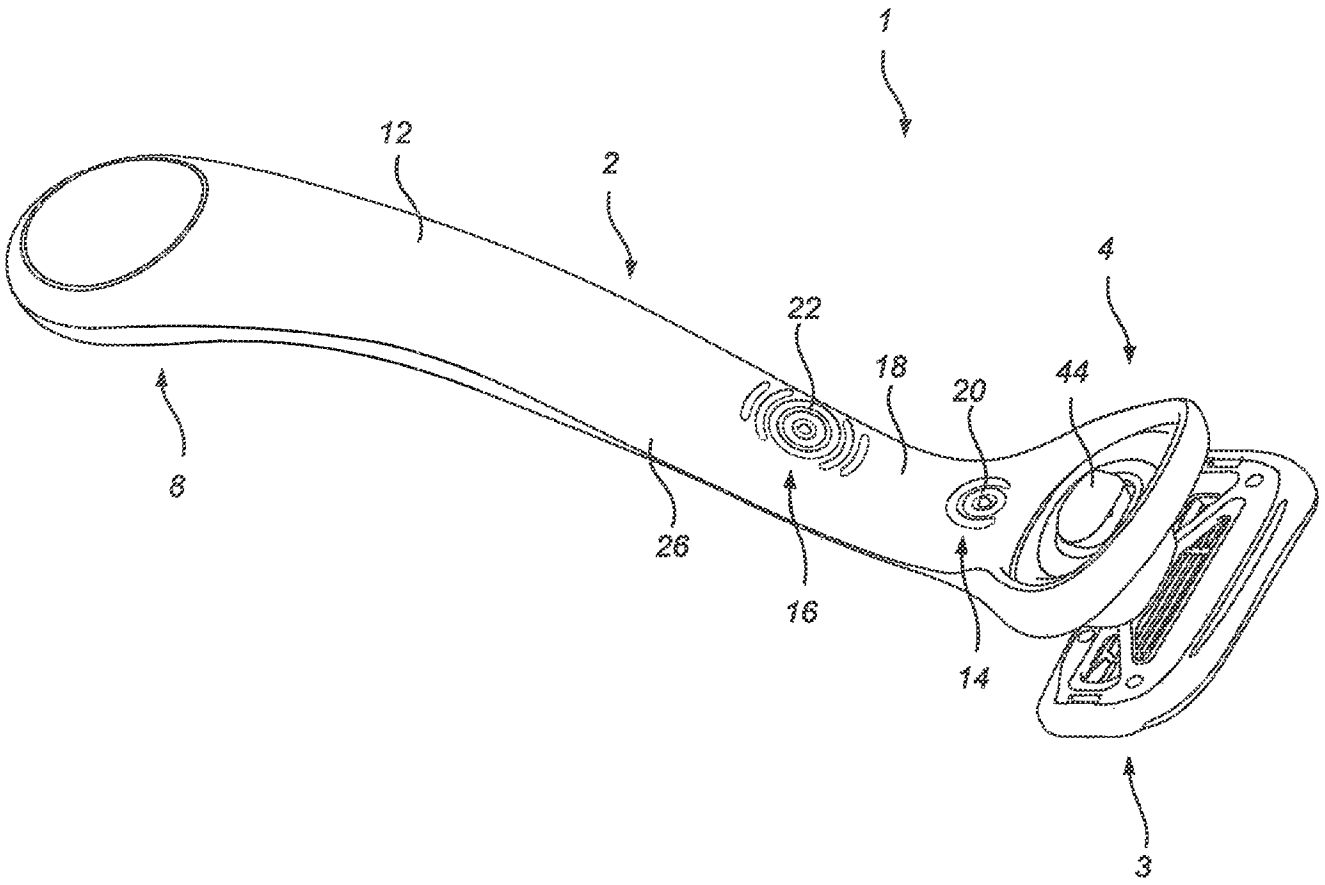
FIG. 10 is a top perspective view of a safety razor which comprises the safety razor handle of FIG. 1 and the razor head of FIG. 5.
Figure 11:
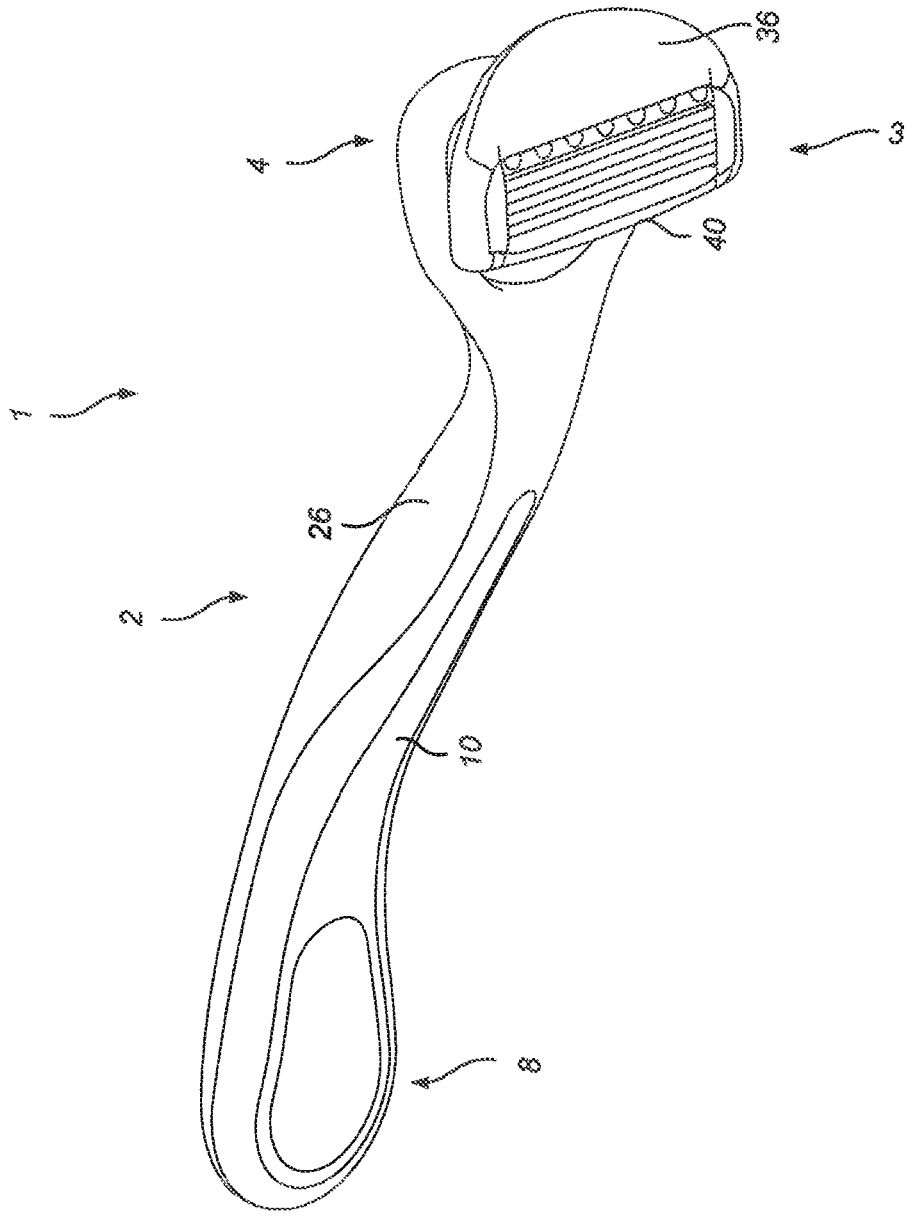
FIG. 11 is a bottom perspective view of the safety razor of FIG. 10.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawings making apparent to those of skill in the art how the several forms of the present invention may be embodied in practice.

FIGS. 1 to 4 show a safety razor handle 2 in the form of an elongated body having an S-shaped configuration extending from a razor head end 4 to a free end 8. The razor head end 4 has a connecting structure 6 to which a razor head (such as the razor head 3 shown in FIGS. 5 to 9) is attachable. The elongated body has a lower surface 10 and an upper surface 12. Here, the term "lower surface" refers to that surface which is on the same side as the cutting edges of the blades when the razor head is connected to the razor handle (as shown in FIGS. 10 to 13). The term "upper surface" refers to that surface which is opposite to the lower surface.

Gripping areas are provided on the upper surface 12 of the handle 2. In particular, a first gripping area 14 and a second gripping area 16 are provided on the upper surface 12, spaced apart by a smooth area 18. The first gripping area 14 is provided by a plurality of arcuate protrusions 20 which are in the form of at least partial circles concentric with each other. Likewise, the second gripping area 16 is provided by a plurality of arcuate protrusions 22 which are in the form of at least partial circles concentric with each other. In this particular case, the first gripping area 14 has two arcuate protrusions 20 (the innermost of which forms a circle and the outermost of which forms a partial circle), and the second gripping area 16 has six arcuate protrusions 22 (the two innermost of which form circles and four outermost of which form two partial circles). Of course, a different number of protrusions is possible.

The concentric centers c1, c2 of the plurality of arcuate protrusions 20, 22 of the first and second gripping areas 14, 16 are aligned longitudinally along the central longitudinal axis (denoted by the dashed line in FIG. 3) of the razor handle. These concentric centers c1, c2 are spaced apart by about 2 cm along the central longitudinal axis of the razor handle (denoted by d1 in FIG. 3).

The smooth area 18 of the upper surface 12 which separates the first gripping area 14 from the second gripping area 16 extends continuously therebetween. The separation distance (denoted by d2 in FIG. 3) along the central longitudinal axis of the razor handle is about 1 cm in length.

Figure 13:
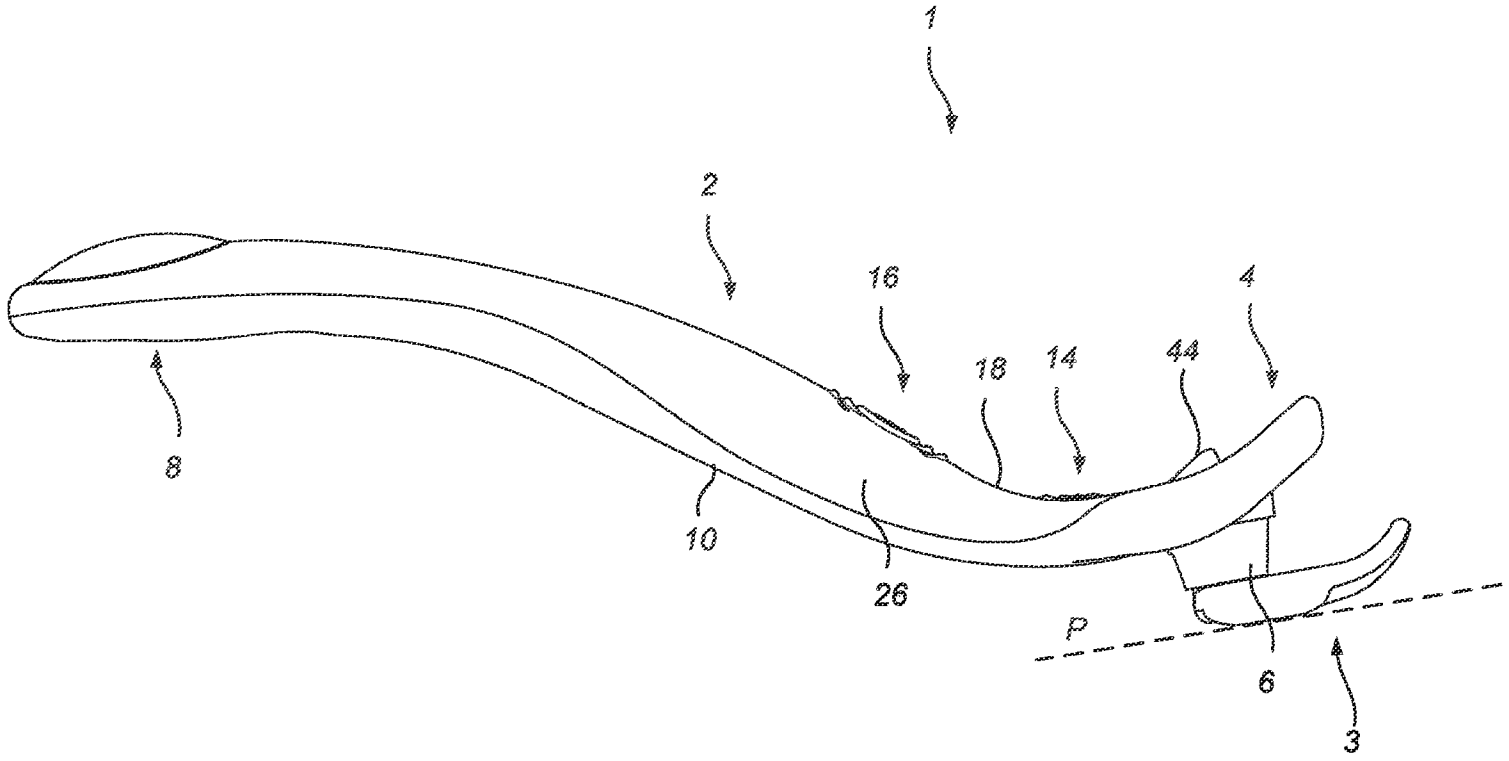
FIG. 13 is a side view of the safety razor of FIG. 10.
Figure 14:
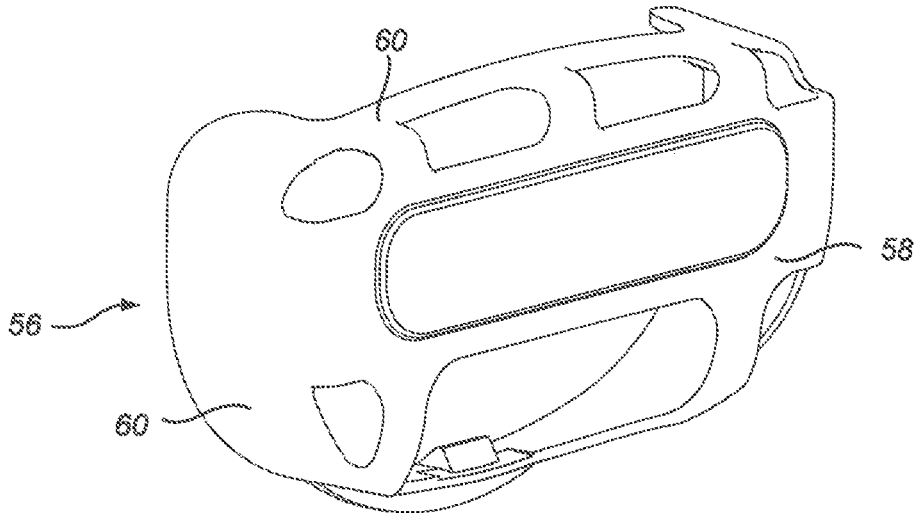
FIG. 14 is a bottom perspective view of a protective cover for the razor head of FIG. 5.
Figure 15:
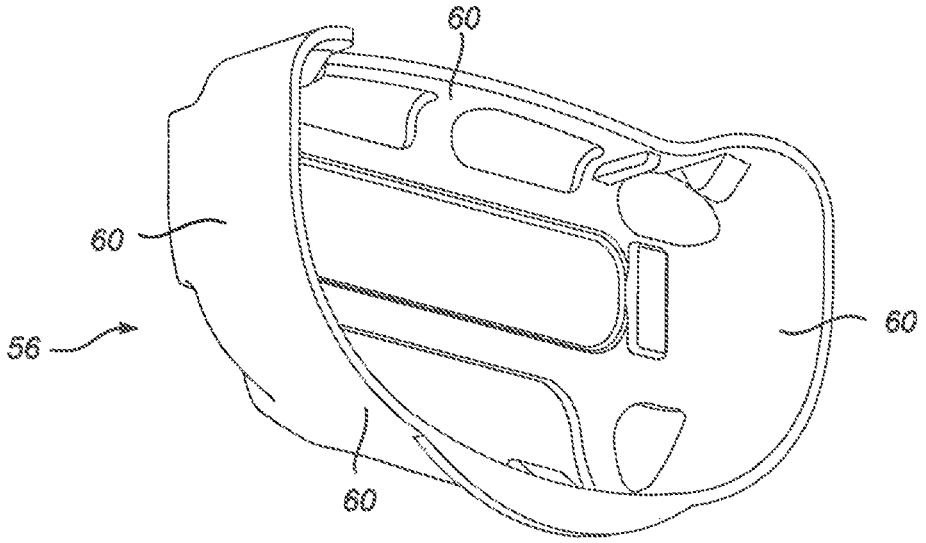
FIG. 15 is a top perspective view of the protective cover of FIG. 14.
Figure 16:
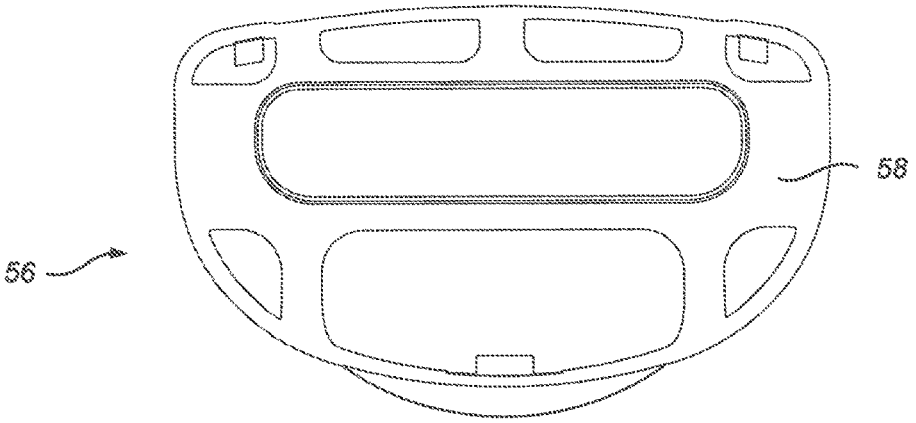
FIG. 16 is a top view of the protective cover of FIG. 14.
Figure 17:
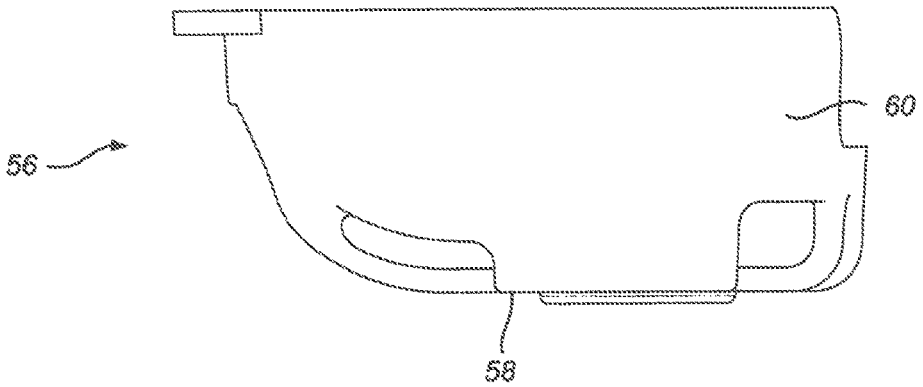
FIG. 17 is a side view of the protective cover of FIG. 14.

The razor head end 4 of the handle 2 includes a pivot mechanism 54 that allows the razor head 3 to pivot back-and-forth in a plane perpendicular to the shaving plane P. The pivot mechanism can, of course, allow other pivoting motions such as side-to-side. In this particular example, the pivot mechanism 54 is an elastomeric member that surrounds the upper portion of the connecting structure 6 of the handle 2. The elastomeric member is surrounded by a generally circular rigid portion of the razor head end 4. As seen in FIG. 13, the razor head end 4 also arcuately bends away from the shaving plane P, to permit the cap 34 of the blade housing 30 to pivot backwards, i.e., to bend away from the shaving plane, over a large angular range.

The handle can be comprised of a rigid plastic and an elastomeric material disposed on rigid plastic. A majority of the upper surface 12 can be covered by the elastomeric material. For example, the elastomeric material can extend from the free end 8 of the handle 12 up to and including the pivoting mechanism 54 on the razor head end 4 of the handle 12.

Figure 12:
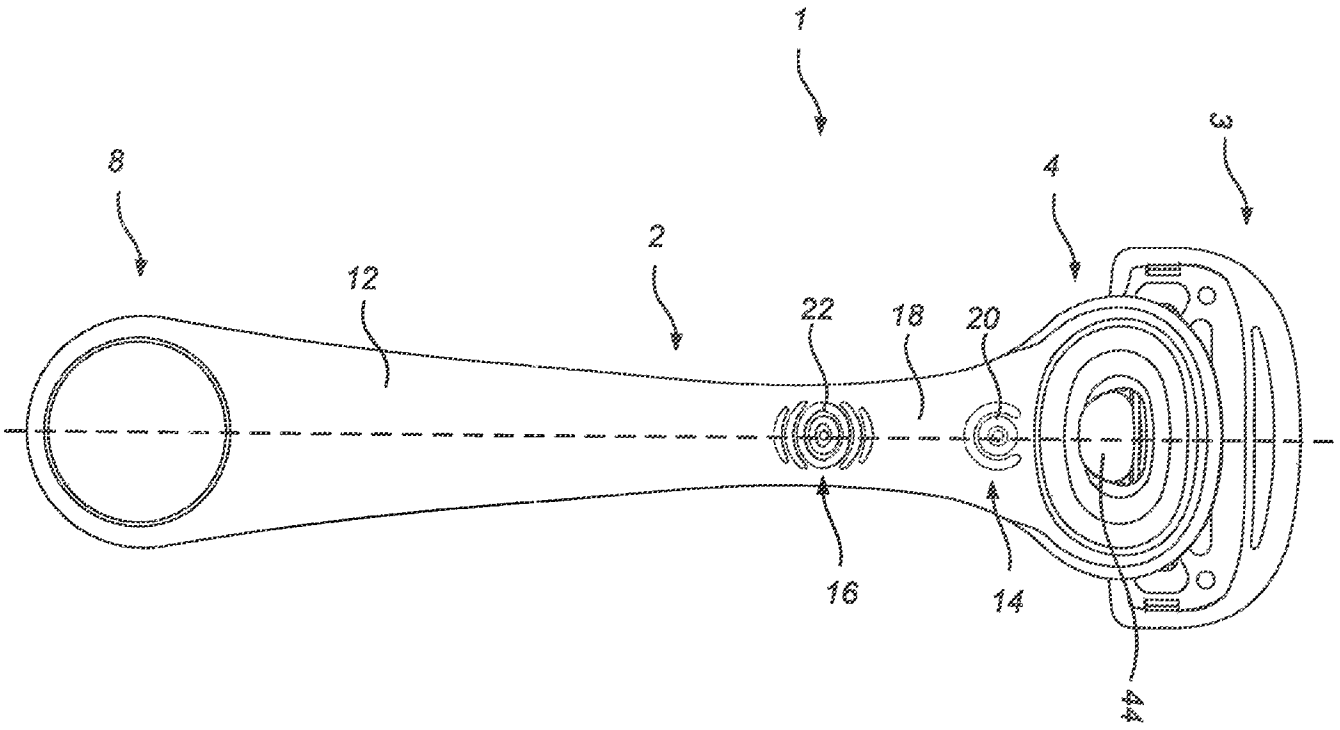
FIG. 12 is a top view of the safety razor of FIG. 10.

FIGS. 5 to 9 show an exemplary razor head 3 that can be used in conjunction with the razor handle 2 shown in FIGS. 1 to 4. The razor head 3 includes a connecting structure 28, to engage with the connecting structure 6 of the razor head end 4 of the handle 2, and a blade housing 30. The blade housing 30 holds a plurality of blades 32 (five blades in this particular case) having respective cutting edges that lie in a shaving plane P. Thus, as used herein, the term "shaving plane" generally refers to the place in which the cutting edges lie. Although blade units are described in which four or five parallel blades lying in a shaving plane are provided, the blade housing may comprise more than five blades or fewer than four blades, i.e., the blade housing may comprise at least one blade. When more than one blade is provided, these do not have to lie in a shaving plane, for example the blades could be staggered. The blade housing 30 comprises a cap 34, including a lubricating pad 36, located behind the blades in a shaving direction s, and a guard 38, including a lubricating strip 40, located in front of the blades 32 in the shaving direction s, and side walls 42 connecting the guard 38 and the cap 34. As used herein, the term "shaving direction" signifies the direction in the shaving plane in which the blade unit is intended to be moved. The cap 34 and the guard 38 are connected by side walls 42. The connecting structure 28 of the razor head 3 includes a release button 44 to release the razor head 3 from the razor handle 2. As seen in FIG. 12, the release button 33 is aligned with the first and second gripping areas 14, 16 in the longitudinal axis. The release button 44 is mounted on an arm 46 which is resiliently bendable towards a fixed structure 48 of the razor head 3 when the release button 44 is pressed. In particular, when the user presses the release button 44 downwards, towards the cap 34 of the razor head 3, the arm 46 bends. The release button 44 has a downwardly extending projection 50 to abut an upwardly extending projection 52 of the fixed structure to limit the movement of the arm 46 when the release button 44 is pressed.

In use, the user can grasp the free end 8 of the handle 2 in the palm of their hand with ring and little fingers on the lower surface 10, thumb and middle finger on the sides 24, 26 of the handle 2 respectively (in a central region between the razor head end 4 and the free end 8), and index finger on the first or second gripping areas 14, 16.

FIGS. 14 to 17 show a protective cover 56 for the razor head 3 when it is not in use. The protective cover 56 is comprised of a plastic or polymeric material. The protective cover 56 comprises a base 58 and side walls 60 extending upwardly from the base 58. The side walls 58 are integral with one another and configured to surround the outer periphery of the cap 34, guard 38 and side walls 42 of the razor head 3. Both the base 58 and the side walls 60 can have cut-out portions in order to reduce the amount of material usage. The cover 56 can be placed on the razor head 3 from below, i.e., from a direction perpendicular to the shaving plane, while the razor head 3 is still attached to the handle 2.

The breadth and scope of the present invention should not be limited by any of the above-described exemplary embodiments, but should be defined only in accordance with the following claims and their equivalents.

DRAWING REFERENCE NUMERALS

Razor 1
Razor handle 2
Razor head 3
Razor head end 4
Connecting structure (of handle) 6
Free end 8
Lower surface 10
Upper surface 12
First gripping area 14
Second gripping area 16
Smooth area 18
Arcuate protrusions (of first gripping area) 20
Arcuate protrusions (of second gripping area) 22
Side surfaces 24, 26

Connecting structure (of razor head) 28
Blade housing 30
Blades 32
Cap 34
Lubricating pad 36
Guard 38
Lubricating strip 40
Side walls (of blade housing) 42
Release button 44
Arm 46
Fixed structure 48
Downward projection 50
Upward projection 52
Pivot mechanism 54
Protective cover 56
Base 58
Side walls (of protective cover) 60

What is claimed is:

1. A razor handle for a razor head having blades, wherein the razor handle is in the form of an elongated body and comprises:

a razor head end with a connecting structure, to connect the razor handle to the razor head;

a free end opposite the razor head end;

a lower surface on the same side as cutting edges of the blades of the razor head when the razor head is connected to the razor handle;

an upper surface opposite the lower surface;

a first gripping area arranged on the upper surface, to provide a first gripping position for a finger or thumb of the user; and a second gripping area arranged on the upper surface, to provide a second gripping position for the finger or thumb of the user, wherein the first and second gripping areas (i) have textured surfaces and are separated from one another by a smooth area of the upper surface, (ii) are closer to the razor head end than the free end, and at least one of: (iii) are the only gripping areas present on the upper surface and (iv) are of a different size;

and wherein the first and second gripping areas are provided by a plurality of arcuate protrusions which are in the form of at least partial circles of different size concentric with each other, a concentric center of the plurality of arcuate protrusions of the first gripping area being spaced apart from a concentric center of the plurality of arcuate protrusions of the second gripping area by from about 1.5 cm to 2.5 cm along a central longitudinal axis of the razor handle.

2. The razor handle of claim 1, wherein at least one of the at least partial circles of different size concentric with each other of at least one of the first and second gripping areas is a partial circle.

3. The razor handle of claim 1, wherein at least one of the at least partial circles of different size concentric with each other of each of the first and second gripping areas is a partial circle.

4. The razor handle of claim 1, wherein the concentric center of the plurality of arcuate protrusions of the first gripping area is spaced apart from the concentric center of the plurality of arcuate protrusions of the second gripping area by about 2 cm along the central longitudinal axis of the razor handle.

5. The razor handle of claim 1, wherein the upper surface is comprised of an elastomeric material that is integral with, and the same as, the material of the first and second gripping areas.

6. The razor handle of claim 1, wherein the first and second gripping areas are the only gripping areas present on the upper surface and are of a different size.

7. The razor handle of claim 1, wherein the first gripping area is closer to the razor head end than the second gripping area and wherein the first gripping area is from about 0.5 cm to 1 cm in length along a central longitudinal axis of the razor handle and the second gripping area is from about 1.0 cm to 2.0 cm in length along a central longitudinal axis of the razor handle.

8. The razor handle of claim 1, wherein the smooth area of the upper surface which separates the first gripping area from the second gripping area is from about 0.5 cm to 1.5 cm in length along a central longitudinal axis of the razor handle.

9. The razor handle of claim 1, wherein the smooth area of the upper surface which separates the first gripping area from the second gripping area is longer along a central longitudinal axis of the razor handle than at least the first gripping area.

10. The razor handle of claim 1, wherein the smooth area of the upper surface which separates the first gripping area from the second gripping area is about as long along a central longitudinal axis of the razor handle as the second gripping area.

11. The razor handle of claim 1, wherein the elongated body has a generally S-shaped configuration extending from the razor head end to the free end.

12. A safety razor, wherein the razor comprises the razor handle of claim 1 and a razor head comprising a plurality of blades with respective cutting edges which lie in a shaving plane and which exert a cutting action when moved across a user's skin in a shaving direction.

13. The safety razor of claim 12, wherein the razor head is detachable from the razor handle.

14. The safety razor of claim 12, wherein the razor head comprises a connecting structure to engage with the connecting structure of the razor handle, which connecting structure of the razor head comprises a release button to release the razor head from the razor handle, the release button being aligned with the first and second gripping areas.

15. The safety razor of claim 14, wherein the release button is mounted on an arm which is resiliently bendable towards a fixed structure of the razor head when the release button is pressed, the release button having a downwardly extending projection to abut an upwardly extending projection of the fixed structure to limit the movement of the arm when the release button is pressed.

16. A safety razor assembly, wherein the assembly comprises:

the safety razor of claim 12, wherein the razor head comprises a guard in front of a plurality of blades of the razor head and a cap behind the plurality of blades, and the razor assembly further comprises a protective cover to at least partially cover each of the guard, the cap and the plurality of blades.

* * * * *